US006135560A

United States Patent [19]

Fagg

[11] Patent Number: 6,135,560

[45] Date of Patent: Oct. 24, 2000

[54] TRAVEL HEADREST PILLOW COMPRISING PILLOW CUSHION AND NECK, HEAD AND SHOULDER SUPPORT (THE JETREST)

[76] Inventor: David J. Fagg, Galaxy Apartments, Tower 1, Apartment 29 I, 7000 Boulevard East, Guttenberg, N.J. 07093

[21] Appl. No.: 09/373,852

[22] Filed: Aug. 13, 1999

Related U.S. Application Data

[60] Provisional application No. 60/110,067, Nov. 27, 1998, and provisional application No. 60/117,515, Jan. 28, 1999.

[51] Int. Cl.[7] ..... A47G 9/00

[52] U.S. Cl. ..... 297/391; 5/636; 5/644

[58] Field of Search ..... 5/636, 490, 644, 5/633; 297/391, 395, 393; D6/502, 601

[56] References Cited

U.S. PATENT DOCUMENTS

| | | | |
|---|---|---|---|
| D. 203,251 | 12/1965 | Barber | 5/636 |
| D. 405,854 | 2/1999 | Grant | D6/601 |
| D. 408,676 | 4/1999 | Straub et al. | D6/601 |
| 941,043 | 11/1909 | Powell | 297/391 |
| 2,336,707 | 12/1943 | Thomspon | 5/636 |
| 2,521,780 | 9/1950 | Dodd | 5/636 |
| 2,522,120 | 9/1950 | Kaskey | 5/636 |
| 2,582,571 | 1/1952 | Thoma . | |
| 2,856,366 | 10/1958 | Novak | 252/363.5 |
| 2,896,227 | 7/1959 | Reed | 5/644 |
| 3,578,383 | 5/1971 | Earl | 297/391 |
| 3,848,281 | 11/1974 | Mathews | 5/636 |
| 4,031,578 | 6/1977 | Sweeney et al. | 5/636 |
| 4,042,278 | 8/1977 | Jensen | 297/397 |
| 4,114,948 | 9/1978 | Perkey | 297/397 |
| 4,285,081 | 8/1981 | Price | 5/636 |
| 4,345,347 | 8/1982 | Kantor | 5/636 |
| 4,440,443 | 4/1984 | Nordskog | 297/397 |
| 4,617,691 | 10/1986 | Monti | 5/636 |
| 4,738,488 | 4/1988 | Camelio | 297/393 |
| 4,776,049 | 10/1988 | Perron | 5/636 |
| 5,025,518 | 6/1991 | Summer | 5/636 |
| 5,046,205 | 9/1991 | Garcia | 5/644 |
| 5,129,705 | 7/1992 | Wray | 297/397 |
| 5,205,611 | 4/1993 | Stephens | 5/636 |
| 5,471,690 | 12/1995 | McNeil | 5/644 |
| 5,535,467 | 7/1996 | Ciske | 5/636 |
| 5,567,015 | 10/1996 | Arias | 297/397 |
| 5,586,350 | 12/1996 | Thönnessen et al. | 5/636 |
| 5,860,177 | 1/1999 | Jung | 5/636 |

FOREIGN PATENT DOCUMENTS

| | | | |
|---|---|---|---|
| 2173095 | 10/1986 | United Kingdom | 5/490 |

*Primary Examiner*—Alexander Grosz

[57] ABSTRACT

A headrest pillow for supporting the head of a user resting against any surface. The headrest pillow comprising a neck, head and shoulder (2) support composed of flexible material with a cross-sectional contour that is complementary to the shape formed by the back of the user's neck, head and shoulder for fitting between the user and the surface against which the user is resting. The headrest pillow also comprising a pillow cushion (1) composed of flexible material, having a base that is connected to one end of a head, neck and shoulder support (2), leaving the other end of the support free. The purpose of pillow cushion being to support the user's head at an angle of between 5–45 degrees (preferably 25–35 degrees) from a vertical plane when the attached support is fitted between the user's neck, head and shoulder and the surface against which the user is resting. The pillow cushion (1) has a shape that is conical-like, hemispherical-like, spherical-like or wedge-like and the support further comprises three flattened cylindrical sections that extend parallel to one another. The forces of the user's body in sleep naturally push the pillow cushion section against the face of the resting surface and onto the user's shoulder.

11 Claims, 5 Drawing Sheets

TRAVEL HEADREST PILLOW COMPRISING PILLOW CUSHION AND NECK, HEAD AND SHOULDER SUPPORT (THE JETREST)

CROSS-REFERENCE TO RELATED APPLICATIONS

This application claims benefit, under 35 U.S.C. § 119(e), from U.S. Provisional Patent Application No. 60/110,067, filed Nov. 27, 1998, and U.S. Provisional Patent Application No. 60/117,515, filed Jan. 28, 1999.

BACKGROUND OF THE INVENTION

1. Field of the Invention

This invention relates to travel headrest pillows.

2. Description of Prior Art

Travelers have used a wide variety of pillows on trains, buses, airplanes, and cars to permit the individual to sleep while traveling. Prior travel pillows have tended to be flawed in terms of lacking satisfactory attention to ergonomic design, requiring permanent attachment to the seat or fitting around the neck of the individual like a collar to provide a stationary support for the head. Also, the bulk of inventions have employed pillow cushion supports on both sides of the user's head, which have either prevented proper support and/or been too bulky when in their preferred embodiments.

The real test of a device's ergonomics is its ability to operate optimally against any surface; this is where my invention excels, being highly effective even when used against a wall.

U.S. Pat. No. 4,031,578 to Sweeney et al., June 1997 discloses a travel pillow described for use with seats that provide an accommodating headrest. This pillow cushions the user's neck and head in a cavity and thus provides support against 'head-rolling' and the sudden 'head-drooping' which usually results when a traveler attempts to sleep while sitting in a generally upright position. However, the combination of a single sided conical-like, hemispherical-like, spherical-like or wedge-like pillow cushion and the flexible material covering/filling used in my invention provides greater support and comfort for the user's head, without clamping it in place but still removing the majority of head roll. My design when represented in its preferred embodiment results in a more realistic 'pillow feel'. Also, in my invention, the use of a support employing a cross-sectional contour that is complementary to the shape formed by the back of the user's neck, head and shoulder allows them to experience full neck support whilst the pillow cushion is held securely in place. The user's head nestles in the junction of the support and the pillow cushion without restricting movement and without the requirement of two pillow sections to either side. Amongst other benefits, this reduces the size of my invention compared with U.S. Pat. No. 4,031,578 and others.

Neck engaging pillows such as illustrated by U.S. Pat. Nos. 5,129,705; 4,776,049; 4,738,488; 4,617,691; 4,345,347; 4,285,081; 2,522,120; 2,336,707; 941,043; and 673,372 employ a stationary support for the head by providing a neck engaging yoke. These devices can prevent the neck and the head from free movement and force the head forward which makes them uncomfortable and makes sleep difficult. In addition, this shape does not allow the user's head to be supported at a comfortable angle when the head moves to one side or up and down, as part of the natural sleep pattern. These devices can hence be uncomfortable and awkward, often causing neck strain and resulting in the user waking up.

U.S. Pat. Nos. 5,046,205; 5,025,518; 4,768,246; and 3,848,281 are amongst a class of device which comprise apertured pillows that are adapted to fit the back of the head of an individual in which the head is positioned within the aperture. This design results in hair tugging and consequent sleep disturbance.

U.S. Pat. No. 5,471,690 to McNeil, Dec. 5, 1995 is a slightly evolved example. It discloses a travel pillow in the form of a torus which is inflated and which has an integral bottom backing member adapted to coact with the seat back of a chair in a plane, train, bus, or automobile. This is inferior to my invention as a result of the fact that the torus forces the head to come to rest in a more obtuse angle from the vertical than my invention, causing interruption to sleep and neck strain. Also, the design of most air-filled (only) pillows is such that even if they provide support for the user's head in their preferred embodiment, use of other more flexible fillings can cause the head engaging pillow sections to buckle, with the result that user's head drops to an uncomfortable position. Since many of the materials used to fill my invention (e.g. cotton or cotton/air mix) are more flexible, it provides superior comfort and a 'pillow feel' that promotes better sleep than inventions such as U.S. Pat. No. 5,471,690. The benefits mentioned will not substitute, but be in addition to the benefits mentioned in Pat. No. 5,471,690 (e.g. freer movement, lack of hair trapping etc)

Neck or head clamping devices are also used to promote sleep while traveling. Such devices are illustrated by U.S. Pat. Nos. 2,582,571; 2,856,366; 4,114,948; 4,738,488 and 5,205,611. The subsequent restriction of the head and neck can wake up the individual when the head moves during the sleep.

U.S. Pat. Nos. 4,042,278 and 4,440,443 engage the head loosely since the lateral supports are widely spaced apart. These devices are less effective at promoting sleep as they permit too much head movement.

Another version uses attachment to the seat itself. The most recent example, U.S. Pat. No. 5,860,177 to Jung, Jan. 19, 1999, discloses an adjustable travel pillow unit having a pillow outer shell, a support frame within the shell and an adjustment mechanism. The mechanism allows an arm to extend or retract in alignment with a plane and is movable itself in alignment with a plane perpendicular to the first mentioned plane. However, this differs strongly from my invention as it seeks to attach a pillow to the seat to allow adjustment through a framework mechanism. My invention, on the other hand, has a number of advantages—it does not need to be attached to the seat, saving time and making it safer to use on aircraft. It can also be fitted into a far smaller/lighter packaging as it has no framework (e.g. if air filled, my invention packs flat and if cotton filled, it can be rolled and stored in a small package, re-gaining it's shape upon removal).

BRIEF SUMMARY OF THE INVENTION

A headrest pillow for supporting the head of a user resting against any surface. The headrest pillow includes a neck, head and shoulder support composed of flexible material. The neck, head and shoulder support has a cross-sectional contour that is complementary to the shape formed by the back of the user's neck, head and shoulder. As such, the neck, head and shoulder support may be fitted between the user and the surface against which the user is resting. The headrest pillow also includes a pillow cushion composed of flexible material, having a base that is connected to one end of a head, neck and shoulder support, leaving the other end of the support free. The pillow cushion supports the user's head at an angle of between 5–45 degrees (preferably 25–35 degrees) from a vertical plane when the attached support is fitted between the user's neck, head and shoulder and the surface against which the user is resting. The pillow cushion has a shape that is conical-like, hemispherical-like, spherical-like or wedge-like. The support preferably comprises three flattened cylindrical sections that extend parallel to one another. The forces of the user's body in sleep naturally push the pillow cushion section against the face of the resting surface and onto the user's shoulder.

The invention is constructed in a symmetrical manner (on one axis) in order to allow its position to be switched from left to right shoulder for comfort whilst saving the space of having two identical pillows attached by the mid-section. Both the pillow cushion and neck, head and shoulder support can be filled or constructed of the same, or combination of cotton, air, beans, beads, water, buckwheat and/or open-celled, visco-elastic, temperature sensitive materials. The invention uses a tailored fabric cover that may be removable and may include a pocket on the front open end of the neck, head and shoulder support to house an alarmed timer or clock device. It is intended that the invention should be packaged in a draw-string case that can be carried in or attached to carry on luggage.

Accordingly, several objects and advantages of my invention are:

(a) to provide a headrest pillow that is more ergonomically sound than prior art devices and hence reduces neck strain upon extended periods of travel and promotes natural sleep.

(b) to provide a headrest pillow that, by way of its design, exerts just enough pressure against the back of the neck and head of the user to hold the pillow cushion in place and support the neck in a comfortable and orthopaedically sound position.

(c) to provide a headrest/pillow that has a construction that is symmetrical about one axis such that the pillow cushion can be moved from the left to right shoulder, by rotating the device through 180 degrees, in order to allow selection of the most comfortable position (or switching) during rest periods. This feature also allows the pillow to be stored in a smaller space when out of use/being transported or wedged in between seats via the neckrest element (particularly when seating passengers on airliners).

(d) to provide a headrest pillow that, in its preferred embodiment, looks, feels and performs like a standard bed pillow and hence promotes sleep i.e. is entirely encased in a cotton (or similar) pillowcase, and has the pillow cushion filled with cotton or other such flexible material, allowing the user to comfortably put the weight of their head onto the it and retain full support and comfort.

(e) to provide a headrest pillow that can incorporate an alarmed device in order to wake the user from sleep as required, particularly when on journeys where potential exists to miss a stop. This is important for an effective device such as this invention where fear of oversleeping can reduce periods of sleep significantly; this feature also allows users to wake for on board meals, films etc.—all which can have specific time-tabling.

(f) to provide a headrest pillow that, in its preferred embodiment, can be rolled and stored in a small outer packaging case/bag for easy carriage.

(g) to provide alternative embodiments that can combine benefits of the preferred embodiment of the invention (e.g. pillow-like feel) with other features (such as a part air filled section to save further space)

Further objects and advantages of my invention will become apparent from a consideration of the drawings and ensuing description of it.

DETAILED DESCRIPTION OF THE INVENTION

Figure 1A:
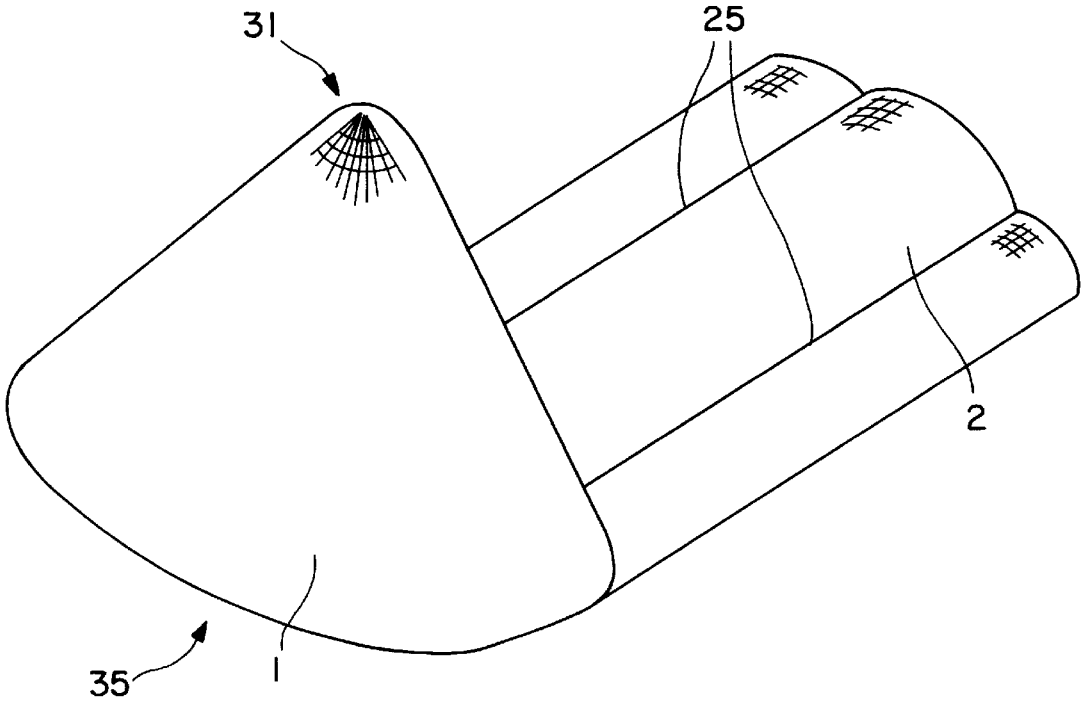
FIG. 1A is a perspective view of the headrest pillow according to the invention.

The headrest pillow of the invention, in its preferred embodiment, is of simple construction, featuring seven key elements (construction will vary slightly for, e.g. inflatable models, where the zips below could be replaced by a single air intake valve). Referring to the figures, wherein like reference numeral designate like components, the key elements of the invention are:

1. A flexible material section joined (e.g. stitched) to form a conical-like pillow cushion (1) casing having an open elongated oval base;
2. A three section material neck, head and shoulder support (2) formed by:
   placing two square material pieces (dimensions of say 9 by 9 inches) atop one another in order that their orientation is identical and stitching the pieces together on three sides, leaving one end open for subsequent filling with the desired filler and for connection to the conical-like pillow cushion; and
   stitching two parallel lines (25) in a direction from the closed end to the open end to create three sections, each section accessible from the open end. The outer sections having a width of approximately 2 inches and the inner section a width of approximately 5 inches.
3. A first zipper (3) which runs the full length of the closed end of the three section material piece to allow it to be opened and closed.
4. A flexible elongated oval material piece (4) of the correct dimensions to be joined to the open end of the conical-like section (1) in order that it becomes completely closed;
5. A second zipper (5) to allow filling to be added to the conical-like section;
6. A filling, which may be the same or different combination for the conical-like section and three section support piece (not shown in drawings);

7. A tight fitting removable pillowcase (7) to cover the entire invention and including a small pocket (27) on the front side, at the opposite end to the pillow cushion.

Figure 5:
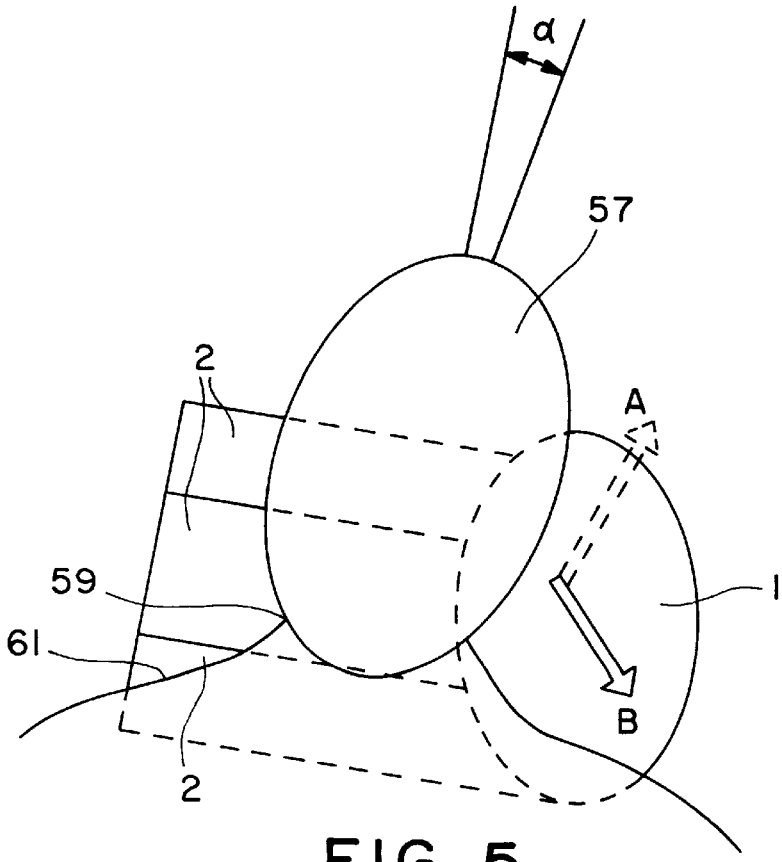
FIG. 5 is a view of the headrest pillow according to FIG. 1A in use.

Now with reference to FIG. 1A, the pillow cushion (1) is conical-like in its preferred embodiment, with a curved apex (31) and elongated oval base (35). The dimensions of the headrest pillow are not especially critical and, in practice, its size can be varied to meet the dimensions of the user who is to be served by this invention. Thus, in the case of an adult, the headrest pillow will function satisfactorily when the base (35) of the conical-like pillow cushion section is c.8–9 inches in diameter (at its widest part) by 6–8 inches in diameter (at its narrowest point) and the height of said pillow cushion rises to c.7–10 inches at its highest point. This will allow the base (35) of the conical-like section to rest comfortably upon (and slightly behind) the user's shoulder. As shown in FIG. 5, the pillow cushion (1) serves to receive the users' head and to support it at an angle $\alpha$ of between c.5–45 degrees (preferably 25–35 degrees) from the vertical whilst resting or reclining.

With reference to FIGS. 1A, and 2–5, the three section neck, head and shoulder rest section (2) takes the form of three flattened cylinders. Again, for an adult, a good result may be achieved if the support is between c.8–11 inches at the longest point of its length (as measured from its junction with the base of the pillow cushion) and with a width of c.8–9 inches (i.e. similar in dimension to the widest part of the pillow cushion's base diameter). The depth of the three section neck, head and shoulder support should be no greater than 3 inches at its widest point when filled (i.e. at the central section).

Referring to FIG. 5, for an adult user, these dimensions are such that the neck, head and shoulder support (2) receives the back of a user's head (57), neck (59), and shoulder (61) in such a manner that it is supported generally on or close to the back of the receiving surface (or the like) and part of the weight of the user's head is supported by the neck and head rest portions (as indicated by force Arrow A), whilst the rest is supported by the conical-like pillow cushion (1) (as indicated by force Arrow B). In addition, the neck, head and shoulder support (2) serves to comfortably hold the pillow cushion in place.

Figure 1B:
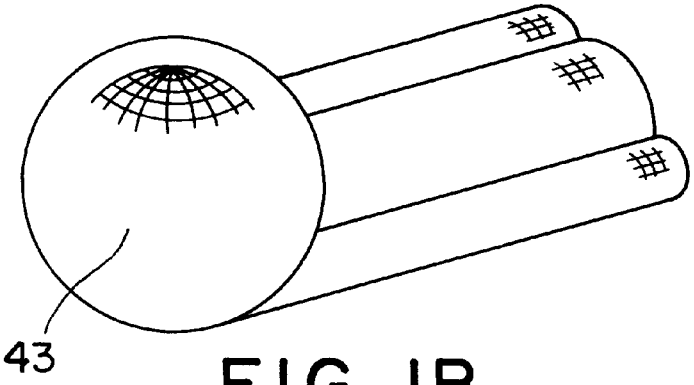
FIGS. 1B, 1C and 1D show perspective views of additional embodiments of the invention using differently shaped pillow cushions.
Figure 1C:
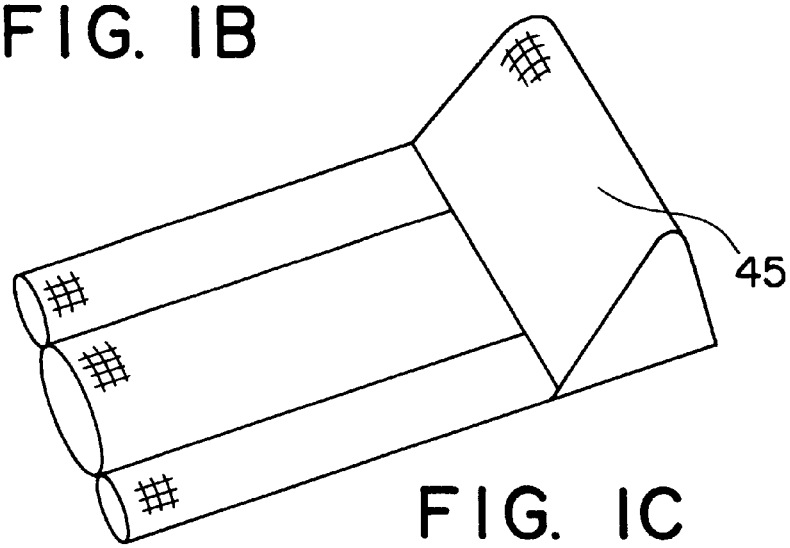
Figure 1D:
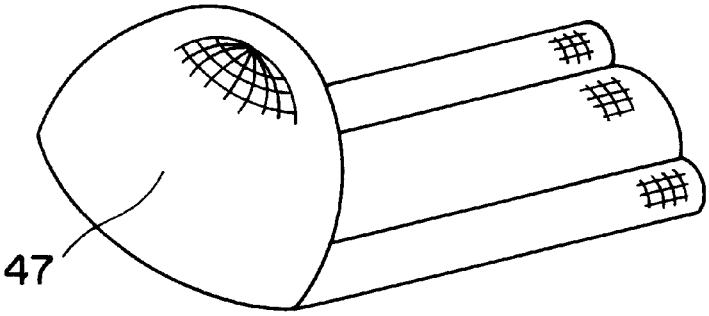

FIGS. 1B, 1C and 1D illustrate alternative pillow cushion shapes that achieve a similar, but slightly less optimal result, when compared with the preferred embodiment illustrated in FIG. 1A. They are, respectively, of spherical-like (43), wedge-like (45) and hemispherical-like (47) construction.

Figure 2:
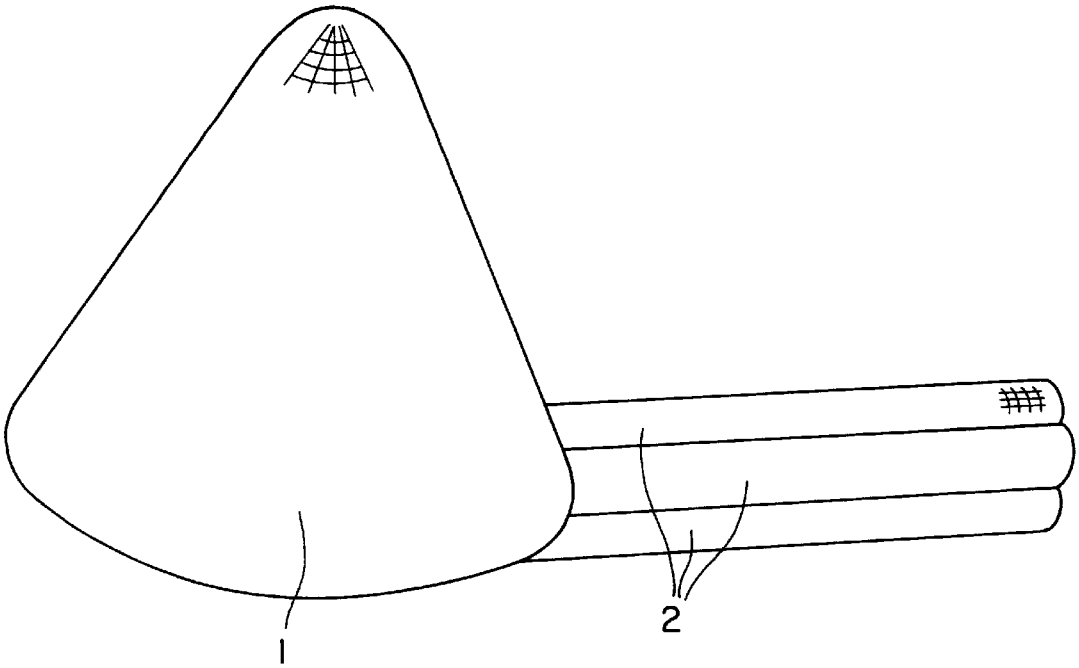
FIG. 2 is a front view of the headrest pillow according to the invention.

FIG. 2 illustrates a side view of the headrest pillow of the invetnion and indicates the nature of the join between the three section neck, head and shoulder support (2) and the open portion of the pillow cushion (1).

Figure 3:
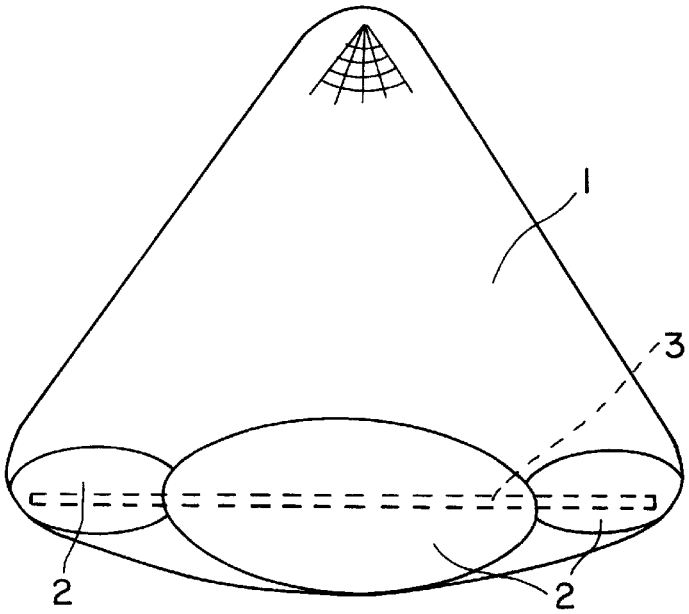
FIG. 3 is a side view of the headrest pillow according to FIG. 1A (viewed as if looking with the neck, head and shoulder support closest to the viewer).

FIG. 3 shows a side view of the headrest pillow as if viewed with the three section neck, head and shoulder support closest to the viewer. From this view, it is possible to notice the symmetrical nature of the headrest pillow through the vertical axis as it joins the tip of the conical-like pillow cushion (1). As such, when the users' neck rests on the neck, head and shoulder rest support, it is pushed backwards until it meets the back of the receiving surface. This action serves to bend its end with the pillow cushion moving forward on (and into) the users shoulder and engaging their head. As such, the pillow cushion (1) is positioned in a manner that receives the cheek of the user as they put their weight into it. This helps prevent a forward movement of the head and provides a comfortable and more supportive position than previously achieved by other travel pillows.

Figure 4:
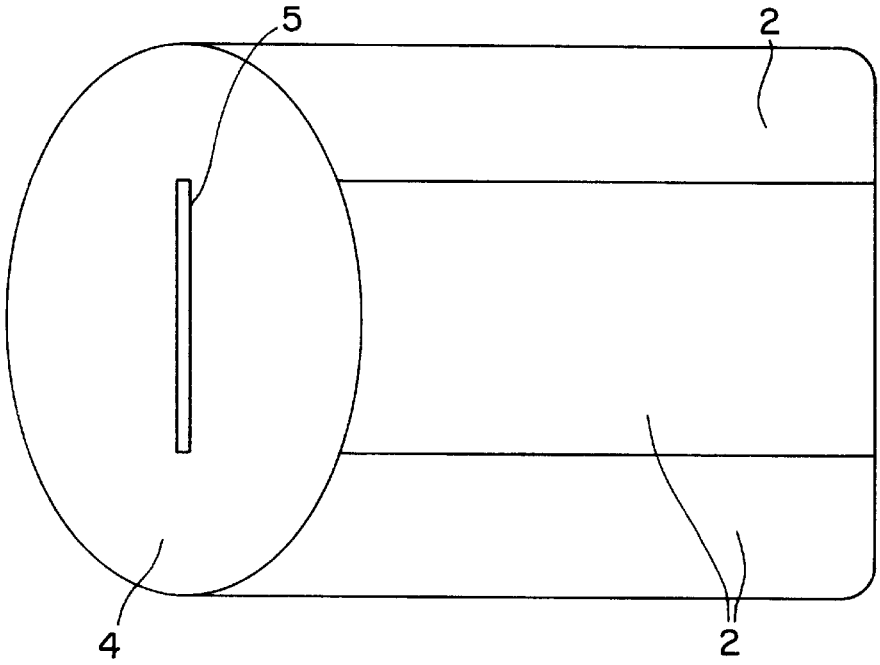
FIG. 4 is a bottom view of the headrest pillow according to FIG. 1A.

FIG. 4 illustrates a bottom view of the headrest pillow of the invention and from this illustration it is readily apparent that the breadth or thickness of said pillow is not particularly great and that it can vary to suit the size of the individual whom it is designed to serve. It also shows a zipper (5), which (like zipper 3) is used for the purpose of filling the pillow in its preferred embodiment. The drawings do not show the fillings (6 above and as discussed below).

FIG. 5 illustrates how the user's head, neck and shoulders/body interact with the headrest pillow of the invention.

In the preferred embodiment of this invention the entire headrest pillow simply consists of an outer shell which is shaped to the specifications illustrated by FIGS. 1–4. The conical-like pillow cushion shell (1) is then stuffed with a cotton (or similar) filling and the three section neck, head and shoulder support (2) with a cotton/buckwheat (or similar) filling. This allows the pillow to provide excellent support and 'bed pillow like' comfort for the head whilst shaping perfectly to the cavity between the neck and the vehicle seat in order to provide a flush fit and to allow the pillow cushion to be supported comfortably in place. Polystyrene beans/beads, water etc. could also be used as fillings.

In addition, the headrest pillow of the invention may be constructed of any flexible material that will allow it to accommodate individuals whose measurements vary to a certain degree. Consequently, in practicing this invention, it may be desirable to construct the pillow from a suitably adaptable material such as foam rubber, open-celled, visco-elastic, temperature sensitive materials or the like (using a unitary construction via molding).

Figure 6:
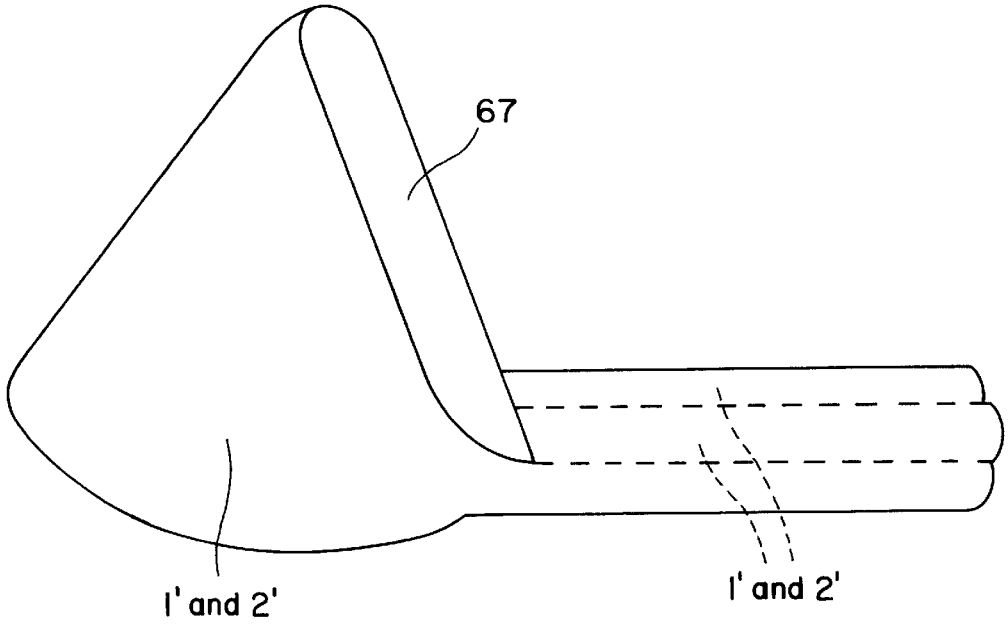
FIG. 6 is a view of an alternative embodiment of the headrest pillow according to the invention having two a first part cushioned and a second part air filled.

The headrest pillow could also be constructed from an inflatable plastic or rubber material. According to this feature of the invention, the inflatable pillow is deflated for storage when it is not being used and is inflated for instant use. Such a pillow has the distinct advantage of being easily stored and, therefore, has particular appeal to airlines. Finally, as shown in FIG. 6, an inflatable elements (1' and 2') could be combined with, say, a cotton element (67) in the pillow cushion in order to provide the benefits of reduced storage space with additional comfort; this is likely to be a very popular compromise between comfort and compactness.

Figure 7:
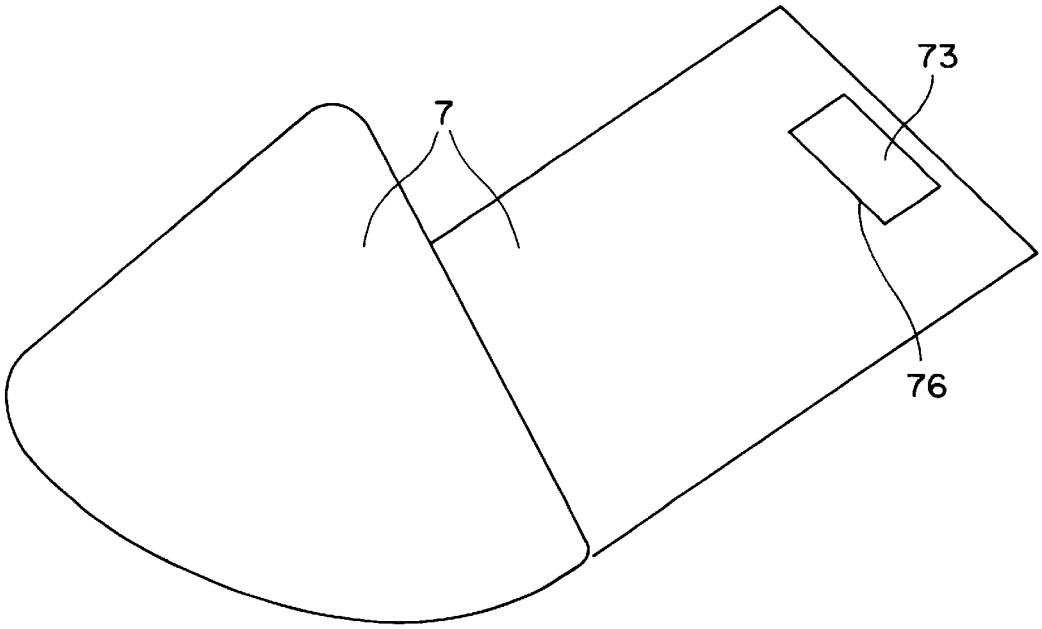
FIG. 7 is a perspective view of a tight fitting pillowcase for encasing the body of the headrest pillow according to the invention.

FIG. 7 illustrates a removable pillowcase (7), used to fully encase the body of the headrest pillow. This pillowcase may also contain a pocket (73) that can be fastened shut (as illustrated). The primary function of the pocket is to house an alarmed timer or clock device (76). The pillowcase should be constructed of a soft, flame retardant material with good stretching qualities.

Regardless of the means used to construct the headrest pillow, it is characterized by a flexibility which permits it to adapt to the varying contours of the user. However, if the differences to be accommodated are appreciable as, for example, in the case of adults and children, then it is preferable to simply construct pillows of suitably different dimensions so as to provide a sufficiently comfortable neck and head rest for the user.

Also, in any embodiment of this invention we prefer to construct the headrest pillow from flame-retardant material.

In addition, the intention is to market the headrest pillow of the invention together with an aromatherapy oil (such as Lavender) that can be applied to the outer cover in order to assist sleep without marking or damaging the outer fabric.

Although I have described my invention with specificity it should be understood that this invention is not limited to the precise embodiments described herein.

Modifications and variations on this concept will be apparent to those skilled in the art and to the extent that those adaptations are obvious I expressly include them as being within the scope of my invention.

What is claimed is:

1. A travel headrest pillow for supporting the head of a user resting in a generally upright position against a substantially upright surface, the headrest pillow comprising:

a neck, head and shoulder support (2) composed of flexible material, the support further having dimensions of approximately 8–11 inches by 8–9 inches by 0.5–3.0 inches the support having an outer face forming a cross-section contour that is complementary to the shape formed by the back of the user's neck, head and shoulder, and an inner face for contacting the surface, the support for fitting between the back of the user's neck, head, and shoulder and the surface;

a pillow cushion (1) composed of flexible material, the pillow having abase that is connected to one end of the head, neck and shoulder support (2) leaving the other end of the support free, the pillow cushion (1) for supporting the user's head when the support is fitted between the back of the user's neck, head and shoulder and the surface, the pillow cushion having a shape that is conical with a rounded apex or hemispherical the pillow cushion base having an elongated oval shape with base dimensions of approximately 8–9 inches by 6–8 inches and a height rising to approximately 7–10 inches, the pillow cushion for supporting the user's head at an angle $\alpha$ of between 5–45 degrees from a vertical plane.

2. The travel headrest pillow according to claim, 1, where the support (2) further comprises three flattened cylindrical sections that extend parallel to one another in a horizontal direction.

3. The travel headrest pillow according to claim 1, where the shape is symmetrical such that the pillow is reversible.

4. The travel headrest pillow according to claim 1, where the support is composed of a hollow shell filled with a compressible material.

5. The travel headrest pillow according to claim 4, where the material is air, beans, beads, water, buckwheat, an open-celled, visco-elastic, temperature sensitive material or a combination of said materials.

6. The travel headrest pillow according to claim 4, where the hollow shell and material are washable and flame retardant.

7. The travel headrest pillow according to claim 1, wherein the pillow body is collapsible and may be rolled for compact storage.

8. The travel headrest pillow according to claim 1, where the support (2) and pillow cushion (1) are encased within a removable pillowcase (7) made of flexible, washable, fire resistant material.

9. The travel headrest pillow according to claim 8, where the removable pillowcase (7) further comprises a pocket (73) that may be fastened shut, located on the front side of the pillowcase.

10. The travel headrest pillow according to claim 9, where the pocket (73) houses an alarmed timer or clock device (76).

11. The travel headrest pillow according to claim 8, where the removable pillowcase (7) has applied to its surface a sleep promoting substance such as aromatherapy oil.

* * * * *